US008388767B2

(12) United States Patent
Li et al.

(10) Patent No.: US 8,388,767 B2
(45) **Date of Patent: *Mar. 5, 2013**

(54) CARBONITRIDING LOW MANGANESE MEDIUM CARBON STEEL

(75) Inventors: Huaxin Li, Rochester Hills, MI (US); Silvio M. Yamada, Waterford, MI (US)

(73) Assignee: Arvinmeritor Technology, LLC, Troy, MI (US)

( * ) Notice: Subject to any disclaimer, the term of this patent is extended or adjusted under 35 U.S.C. 154(b) by 2057 days.

This patent is subject to a terminal disclaimer.

(21) Appl. No.: 10/936,239

(22) Filed: Sep. 8, 2004

(65) Prior Publication Data

US 2006/0048856 A1 Mar. 9, 2006

(51) Int. Cl.
*C23C 8/00* (2006.01)
*C23C 22/00* (2006.01)

(52) U.S. Cl. ..... 148/218; 148/233

(58) Field of Classification Search ..... 148/218, 148/318, 233

See application file for complete search history.

(56) References Cited

U.S. PATENT DOCUMENTS

| | | | | |
|---|---|---|---|---|
| 4,470,854 | A | 9/1984 | Nakamura | |
| 5,595,610 | A * | 1/1997 | Maeda et al. | 148/233 |
| 6,083,456 | A | 7/2000 | Van Rees | |
| 2003/0104872 | A1 | 6/2003 | Lobozov et al. | |
| 2003/0168230 | A1* | 9/2003 | Donazzi et al. | 174/36 |

FOREIGN PATENT DOCUMENTS

| | | |
|---|---|---|
| JP | 2004078823 A1 | 3/2004 |
| RU | 2164536 | 4/2000 |
| RU | 2158320 | 10/2000 |
| RU | 2176754 | 10/2001 |
| RU | 2221058 | 3/2002 |
| RU | 2213280 | 8/2002 |

OTHER PUBLICATIONS

ASM Handbook (vol. 4, Heat Treating, Fig. 1, p. 377/Carbonitriding).*
"Summary of Russian Patents".
U.S. Appl. No. 10/936,264, filed Sep. 8, 2004.

* cited by examiner

*Primary Examiner* — Roy King
*Assistant Examiner* — Weiping Zhu
(74) *Attorney, Agent, or Firm* — Carlson, Gaskey & Olds PC

(57) ABSTRACT

A method for processing a low manganese steel is more cost effective and improves residual stress, bending fatigue, and surface characteristics for driveline components. The low manganese steel comprises in combination, by weight, about 0.30-0.75% carbon (C) and 0.15-0.40% manganese (Mn), with the balance being essentially iron (Fe). The method for processing the low manganese steel includes carbonitriding the low manganese steel at temperatures between 1600° F. to 1750° F. for a time period of about three to six hours. The low manganese steel is subsequently quenched in a water based solution that is kept at room temperature. The process provides the low manganese steel with an irregular case profile with a core hardness of no more than 50 Rockwell C and a surface hardness of approximately 58-63 Rockwell C. Further, the process provides the low manganese steel with little or no intergranular oxidation or surface high temperature transformation product.

38 Claims, 1 Drawing Sheet

CARBONITRIDING LOW MANGANESE MEDIUM CARBON STEEL

TECHNICAL FIELD

The subject invention provides a method of carbonitriding a low manganese content and medium carbon content steel that is more cost effective and improves residual stress, bending fatigue, and surface characteristics for driveline components.

BACKGROUND OF THE INVENTION

Driveline components, such as gears, for example, are traditionally formed from a low carbon content steel. One example of a gear material is SAE 8822H, which is a carburizing grade alloy steel. SAE 8822H has the following chemical composition, in combination, by weight: 0.19-0.25% carbon (C), 0.70-1.05% manganese (Mn), 0.15-0.35% silicon (Si), 0.35-0.75% nickel (Ni), 0.35-0.65% chromium (Cr), 0.30-0.40% molybdenum (Mo), no more than 0.035% phosphorous (P), and no more than 0.040% sulfur (S), with the balance being essentially iron (Fe).

Gear steels, such as SAE 8822H, are specially designed carburization grade steels that are alloyed-low carbon content steels (0.10-0.27% carbon), which traditionally are expensive. Carburizing is a process in which carbon is added to a surface of an iron-base alloy by absorption through heating the alloy at a temperature below a melting point of the alloy, while providing contact with carbonaceous solids, liquids, or gases. In order to achieve desired final hardness and surface characteristics, the SAE 8822H material is carburized, quenched, and tempered.

An example of one current process for carburizing a traditional gear steel, such as SAE 8822H, is as follows. The gear steel is subjected to carburization for 22 hours at 1750° F. for a pinion gear and for 14 hours at 1750° F. for a ring gear. The atmosphere has approximately 1% carbon potential. After carburization, the gear steel is quenched in an oil bath. Additional processing steps, such as tempering and/or shot peening, for example, are then performed to achieve desired final material characteristics.

The process provides a relatively uniform case depth for the ring and pinion gears, which results in requiring only a pitch line case depth to be defined. Case depth at a gear tooth root is not typically defined. Core hardness for ring and pinion gears made by this process is typically no more than 45 Rockwell C at the pitch line, and surface hardness is approximately 58-63 Rockwell C. Microstructure 0.010 inches beneath the surface is martensite and retained austenite. Residual compressive stress is typically less than 50 ksi at the gear tooth root and less than 100 ksi after shot peening.

Thus, carburization for gears and other driveline components is a prolonged process and can take as long as ten to twenty-four hours, depending on case depth requirements. Prolonged processing and expensive steel grades increase manufacturing costs for gears and other driveline components.

Also, the prolonged carburization process causes non-martensite transformation products (NMTP) and intergranular oxides (IGO) to form at a surface of the component. NMTP and IGO adversely affect bending fatigue strength and wear resistance. NMTP is also referred to as surface high temperature transformation product (HTTP). The appearance of HTTP/NMTP results in a softer material at a surface of the component, which is detrimental to wear resistance. IGO is very brittle and is more susceptible to micro-cracking. Thus, IGO results in lower compressive residual stress, which reduces bending fatigue and wear resistance. The occurrence of both NMTP and IGO can significantly reduce service life of the component.

An example of a process used to achieve desired material characteristics for a high carbon content steel (0.60-0.80% carbon) is thru-surface hardening (TSH). This process heats the steel in a controlled furnace atmosphere for about 40 minutes to one hour, and then subsequently quenches the steel in a water based solution. This process provides an irregular case profile and has a root case depth of approximately 0.045 to 0.060 inches for gears. The gear pitch line core hardness is 55 Rockwell C and surface hardness is 58-63 Rockwell C. Microstructure 0.010 inches beneath the surface is martensite only for 0.60% carbon steel, and is martensite and retained austenite for 0.80% carbon steel. This process is undesirable because the core hardness of 55 Rockwell C makes machining very difficult. Further, when the microstructure consists mostly of martensite at the surface, wear resistance is adversely affected.

It is desirable to have an improved process for a driveline component material that does not require prolonged carburization or thru-surface hardening, is less expensive, and provides improved surface characteristics for the driveline components, as well as overcoming the other above-mentioned deficiencies in the prior art.

SUMMARY OF THE INVENTION

A method for processing a low manganese steel includes carbonitriding the low manganese steel at temperatures from about 1600° F. to 1750° F. for a time period from about three hours to six hours. The carbonitriding takes place in an atmosphere having a carbon potential range of about 0.75 to 1.1% and 4 to 8% ammonia ($NH_3$).

In one example, straight carbonitriding is conducted at about 1600° F. for about three to six hours. In this example, the atmosphere preferably has about 0.8% carbon potential and 5% ammonia ($NH_3$).

In another example, carburization occurs at about 1750° F. for about two and one-half hours in an atmosphere having about 1% carbon potential. The temperature is subsequently reduced and carbonitriding is conducted at about 1600° F. for about one and one-half hours in an atmosphere having 0.8% carbon potential and 5% ammonia ($NH_3$).

In either example, the low manganese steel is subsequently quenched in an intense quench process in a water based solution. The water-based solution is preferably at room temperature.

The low manganese steel comprises in combination, by weight, about 0.30-0.75% carbon (C) and 0.15-0.40% manganese (Mn), with the balance being essentially iron (Fe). Further, the alloy composition preferably has no more than about 0.04% aluminum (Al), no more than about 0.035% phosphorous (P), no more than about 0.025% sulfur (S), no more than about 0.15% chromium (Cr), no more than about 0.18% silicon (Si), and/or no more than about 0.08% molybdenum (Mo).

In one example, the method for processing the low manganese steel provides a surface hardness of about 58-63 Rockwell C and a core hardness of no more than 50 Rockwell C. The method also produces a component having an irregular case profile and a microstructure of martensite and retained austenite.

The subject method for processing the low manganese steel provides improved residual stress, bending fatigue, and surface characteristics for driveline components. Further, mechanical properties are improved for these driveline components while material and manufacturing costs are reduced. The carbonitriding cycles are significantly shorter than traditionally used carburization cycles. The method for processing the low manganese steel also provides little or no intergranular oxidation at a component surface and also virtually eliminates surface high temperature transformation product.

These and other features of the present invention can be best understood from the following specification and drawings, the following of which is a brief description.

DETAILED DESCRIPTION OF THE PREFERRED EMBODIMENT

Figure 1:
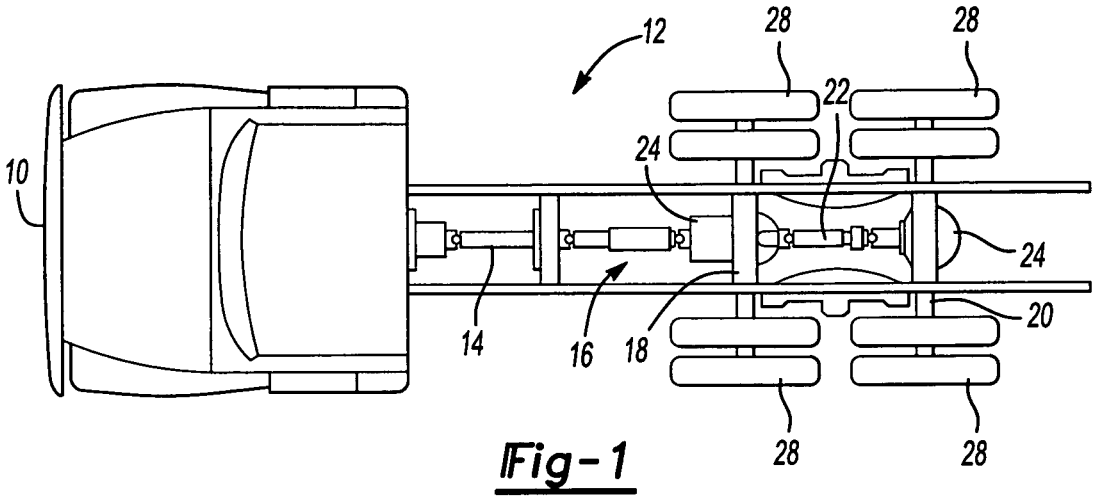
FIG. 1 is a schematic overhead view of a vehicle driveline including a driveline component formed from a material and process incorporating the subject invention.

A vehicle 10 includes a driveline assembly 12. The driveline assembly 12 includes a driveshaft 14 that is coupled to a drive axle assembly 16. The drive axle assembly 16 can be a single drive axle or a tandem drive axle. In the example shown in FIG. 1, the drive axle assembly 16 is a tandem drive axle assembly including a forward-rear axle 18 and a rear-rear axle 20 coupled together with an interconnecting driveshaft 22.

Figure 2:
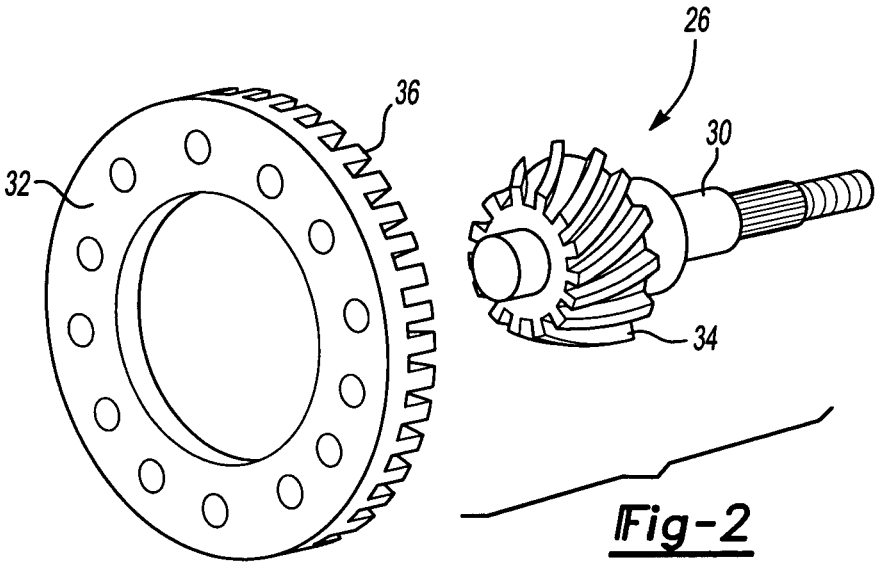
FIG. 2 is an exploded view of one example of a driveline component that can be formed from the material and process incorporating the subject invention.

The forward-rear 18 and rear-rear 20 axles each include a carrier assembly 24 that includes an input gear set 26 (see FIG. 2) and a differential assembly (not shown) that cooperate to drive laterally spaced wheels 28. The subject invention utilizes a unique material and process to form driveline components, such as the input gear set 26, for example. The input gear set 26 typically includes an input pinion 30 that drives a ring gear 32. The input pinion 30 includes a plurality of pinion teeth 34 that meshingly engage a plurality of ring gear teeth 36 formed on the ring gear 32. The input gear set 26 provides driving input into the differential assembly as known.

It should be understood that while the subject invention is described in relation to an input gear set 26, the unique material and process could be used to form other driveline components. Further, the unique material and process could also benefit non-driveline components.

The subject invention is for an alloy composition providing a low manganese (Mn) content, low silicon (Si) content, and medium carbon (C) content steel. The alloy composition comprises in combination, by weight, about: 0.30 to 0.50% carbon (C), 0.15 to 0.40% manganese (Mn), no more than about 0.04% aluminum (Al), no more than about 0.035% phosphorous (P), no more than about 0.025% sulfur (S), no more than about 0.15% chromium (Cr), no more than about 0.18% silicon (Si), and no more than about 0.08% molybdenum (Mo), with the balance being essentially iron (Fe).

As discussed above, this alloy composition can be used as a driveline component material. In one example, the alloy composition is used to form the input pinion 30 and ring gear 32. In this gear example, the alloy composition would preferably have approximately 0.32-0.42% carbon (C) and 0.15 to 0.40% manganese (Mn), the balance being essentially iron (Fe).

In one working example for a gear, the alloy composition comprises in combination, by weight, about: 0.38% carbon (C), 0.23% manganese (Mn), 0.012% phosphorous (P), 0.010% sulfur (S), 0.04% silicon (Si), 0.07% chromium (Cr), 0.02% molybdenum (Mo), 0.20% copper (Cu), and 0.025% aluminum (Al), the balance being essentially iron (Fe). In this example, the iron (Fe) would be about 99.013%.

In another example, the alloy composition is used to form a shaft, such as driveshaft 14. Other shafts such as input shafts to the forward-rear axle 18, the interconnecting driveshaft 22, a thru-shaft for an inter-axle differential assembly (not shown), or axle shafts (not shown) that are driven by the differential assemblies, could also be formed from the alloy composition. In this shaft example, the alloy composition would have approximately 0.42-0.50% carbon (C) and 0.15 to 0.40% manganese (Mn), the balance being essentially iron (Fe).

In one working example for a shaft, the alloy composition comprises in combination, by weight, about 0.46% carbon (C), 0.28% manganese (Mn), 0.020% phosphorous (P), 0.010% sulfur (S), 0.10% silicon (Si), 0.08% chromium (Cr), 0.02% molybdenum (Mo), 0.20% copper (Cu), and 0.025% aluminum (Al), the balance being essentially iron (Fe). In this example, the iron (Fe) would be about 98.805%.

It should be understood that the working examples for the gear and the shaft are just one example of the subject alloy composition for these components and that other combinations of ranges for the above-described elements could also be used depending upon desired final material characteristics.

Further, the subject low manganese, low silicon, medium carbon content steel is an aluminum killed steel. This means that aluminum has been used as a deoxidizing agent. The term "killed" indicates that steel has been sufficiently deoxidized to quiet molten metal when casted.

The unique material of a low manganese (Mn) content, low silicon (Si) content, and medium carbon (C) content steel (LMn-LSi-MCS) is subjected to a unique heat treating process that includes carbonitriding. Carbonitriding is a case-hardening process in which steel components are heated in an atmosphere that includes both carbon (C) and nitrogen (N). Case-hardening is a term that refers to a process that changes the chemical composition of a surface layer of a steel component by absorption of carbon or nitrogen, or a mixture of both carbon and nitrogen. The process uses diffusion to create a concentration gradient so that an outer portion (case) of the steel component is made substantially harder than an inner portion (core).

The subject heat treating process includes carbonitriding the LMn-LSi-MCS for three (3) to six (6) hours at about 1600° F. to 1750° F. in an appropriate furnace atmosphere having about 0.75-1.1% carbon (C) potential and 4.0-8.0% ammonia ($NH_3$). Ammonia is used to provide the nitrogen (N) required by the carbonitriding process. The heat treat can be accomplished in many different ways.

In one example, the carbonitriding is done for 3-5 hours at approximately 1600° F. The target atmosphere for this example is approximately 5% ammonia and 0.8% carbon potential.

In another example, carburization is done for about 2 to 4 hours at a temperature of about 1750° F. in an atmosphere having a target value of approximately 1% carbon potential. The temperature is then decreased to 1600° F. and carbonitriding is done for about 1 to 3 hours. Ammonia is introduced into the furnace atmosphere and the target atmosphere has about 5% ammonia and 0.8% carbon potential.

In either example, once the carbonitriding process is complete, the LMn-LSi-MCS is quenched in a water based solution at room temperature. The quench is preferably a controlled intense quench.

Figure 3:
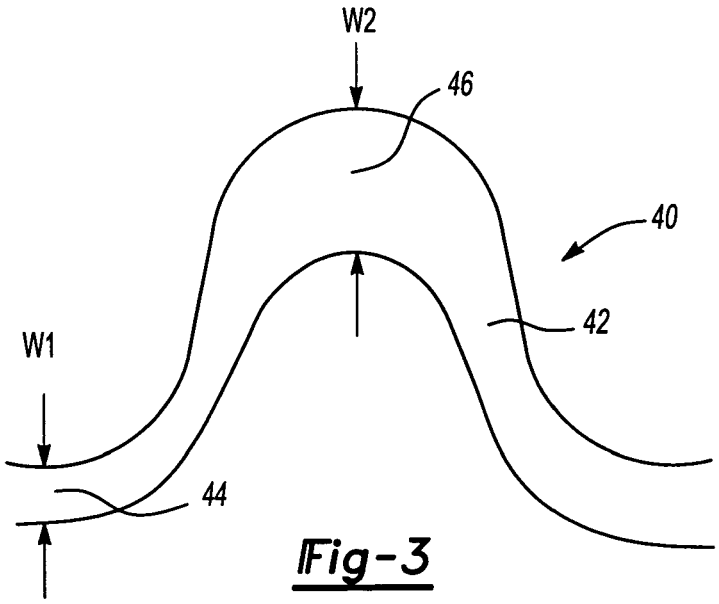
FIG. 3 is a schematic view showing an irregular case profile for a gear tooth formed from the material and process incorporating the subject invention.

The subject process provides an irregular case profile, which is different than the regular case profile produced by a traditional carburizing process. As shown in FIG. 3, a gear tooth 40 has an irregular case profile with a case 42 that has a first width W1 at a tooth root 44 and a second width W2 at a tooth tip 46. As shown, W2 is greater than W1. In this configuration, case depths need to be defined at both a gear pitch line and at the tooth root 44 depending on application and material composition. Also core hardness for the pitch line and case depth for the tooth root 44 will also need to be defined depending on application and material composition.

When the subject process is used on a gear component, for example, the process produces a root case depth of approximately 0.045-0.080 inches. This provides an effective case depth of about 0.45 to 0.80 inches where hardness is no less than 50 Rockwell C. A target core hardness is no more than 50 Rockwell C with a surface hardness in the range of 58-63 Rockwell C.

One of the benefits of this process is that there is very little or no intergranular oxidation (IGO). IGO is detrimental to bending fatigue and wear resistance. IGO is virtually eliminated in this process by limiting the potential for IGO by minimizing the amount of the manganese, silicon, and chromium elements and by reducing the length of heating time. Elimination of IGO provides higher compressive residual stress and virtually eliminates the problem of micro-cracks.

The subject process also significantly reduces the occurrence of surface high temperature transformation product (HTTP). By reducing the length of heating time and adding nitrogen, HTTP is virtually eliminated. HTTP is also detrimental to bending fatigue and wear resistance due to the formation of a softer, non-martensitic material at the surface.

The resulting microstructure at 0.010 inches beneath the surface is martensite and retained austenite. The compressive residual stress is greater than 140 ksi, which is better than can be achieved by carburizing and shot peening, and is the same or better than can be achieved by thru-surface hardening.

While the subject process is used for the LMn-LSi-MCS described above, i.e. the alloy composition having about 0.30-0.50% carbon, it should be understood that the process could be beneficial to other material compositions. For example, the process could be used for alloy compositions having a range of 0.30-0.75% carbon.

This low manganese, low silicon, medium carbon content steel improves mechanical properties and reduces material and manufacturing costs for components. The case depth is controlled by steel chemistries and quench technologies so that there is no need to have prolonged carburization cycles. Further, the lower silicon and manganese contents, in combination with the short carbonitriding cycles, significantly reduces IGO and HTTP. Also, due to the low hardenability of the steel, there are higher surface compressive residual stresses.

Another benefit with the subject process is that all component sizes, i.e. different gear and shaft sizes, can be processed with the same parameters. This is an improvement over the traditional carburizing process, which utilized different lengths of times for different components. The carbonitriding time cycles are also significantly shorter than the carburizing time cycles. This reduces manufacturing costs and processing complexity. Further, the LMn-LSi-MCS is less expensive than carburization grade steel. This reduces material costs.

The subject material and process provides a carbonitrided low manganese, low silicon, medium carbon content steel that is less expensive, easier and cheaper to process, and provides improved mechanical properties. Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A method for processing low manganese steel comprising the steps of:

carbonitriding the low manganese steel having a composition comprising about 0.3-0.75 wt % of carbon, about 0.15-0.40 wt % of manganese, and a balance of iron at temperatures from about 1600° F. to 1750° F. for a time period of about three hours to six hours.

2. The method according to claim 1 including carbonitriding in an atmosphere having about 0.75 to 1.1% carbon (C) potential and 4 to 8% ammonia ($NH_3$).

3. The method according to claim 2 including carbonitriding in an atmosphere having about 0.8% carbon (C) and 5% ammonia ($NH_3$).

4. The method according to claim 1 including subsequently quenching the low manganese steel in a water based solution.

5. The method according to claim 4 wherein the water based solution is at room temperature.

6. The method according to claim 1 including carbonitriding the low manganese steel at a temperature of about 1600° F. for a time period of about three hours to six hours in an atmosphere having about 0.75 to 1.1% carbon (C) potential and 4 to 8% ammonia ($NH_3$).

7. The method according to claim 1 including carburizing the low manganese steel at a temperature of about 1750° F. for a time period of about two to four hours in a first atmosphere having about 0.75 to 1.1% carbon (C) potential and subsequently carbonitriding the low manganese steel at a temperature of about 1600° F. for a time period of about one to three hours in a second atmosphere having about 0.75 to 1.1% carbon (C) potential and 4 to 8% ammonia ($NH_3$).

8. The method according to claim 7 wherein the first atmosphere has about 1% carbon (C) and the second atmosphere has about 0.8% carbon (C) and about 5% ammonia ($NH_3$).

9. The method according to claim 1 including processing the low manganese steel to have an irregular case profile.

10. The method according to claim 1 including processing the low manganese steel to have an effective case depth of about 0.45 to 0.80 inches at a gear tooth root.

11. The method according to claim 1 including processing the low manganese steel to have a core hardness of about 50 Rockwell C.

12. The method according to claim 11 including processing the low manganese steel to have a surface hardness within about 58 to about 63 Rockwell C.

13. The method according to claim 1 wherein the alloy composition has about 0.3 to 0.5% carbon (C).

14. The method according to claim 13 wherein the alloy composition has no more than about 0.04% aluminum (Al).

15. The method according to claim 13 wherein the alloy composition has no more than about 0.035% phosphorous (P).

16. The method according to claim 13 wherein the alloy composition has no more than about 0.025% sulfur (S).

17. The method according to claim 13 wherein the alloy composition has no more than about 0.15% chromium (Cr).

18. The method according to claim 13 wherein the alloy composition has no more than about 0.08% molybdenum (Mo).

19. The method according to claim 13 wherein the alloy composition has no more than about 0.18% silicon (Si).

20. The method according to claim 13 wherein the alloy composition has no more than about 0.04% aluminum (Al), no more than about 0.035% phosphorous (P), no more than about 0.025% sulfur (S), no more than about 0.15% chromium (Cr), no more than about 0.18% silicon (Si), and no more than about 0.08% molybdenum (Mo).

21. The method according to claim 13 including forming the alloy composition into a driveline component for a vehicle prior to carbonitriding.

22. The method according to claim 21 wherein the driveline component is a gear.

23. The method according to claim 21 wherein the driveline component is a shaft.

24. The method according to claim 1 wherein the alloy composition has about 0.32 to 0.40% carbon (C).

25. The method according to claim 24 wherein the alloy composition has no more than about 0.04% aluminum (Al).

26. The method according to claim 25 wherein the alloy composition has no more than about 0.035% phosphorous (P), no more than about 0.025% sulfur (S), no more than about 0.15% chromium (Cr), no more than about 0.18% silicon (Si), and no more than about 0.08% molybdenum (Mo).

27. The method according to claim 26 including forming the alloy composition as a gear for a vehicle driveline component prior to carbonitriding.

28. The method according to claim 27 including providing the gear with a root case depth of about 0.045 to 0.080 inches.

29. The method according to claim 27 having about 0.38% carbon (C), 0.23% manganese (Mn), 0.012% phosphorous (P), 0.010% sulfur (S), 0.04% silicon (Si), 0.07% chromium (Cr), 0.02% molybdenum (Mo), 0.20% copper (Cu), and 0.025% aluminum (Al), the balance being essentially iron (Fe).

30. The method according to claim 1 wherein the alloy composition has about 0.45 to 0.50% carbon (C).

31. The method according to claim 30 wherein the alloy composition has no more than about 0.04% aluminum (Al).

32. The method according to claim 31 wherein the alloy composition has no more than about 0.035% phosphorous (P), no more than about 0.025% sulfur (S), no more than about 0.15% chromium (Cr), no more than about 0.18% silicon (Si), and no more than about 0.08% molybdenum (Mo).

33. The method according to claim 32 including forming the alloy composition as a shaft for a vehicle driveline prior to carbonitriding.

34. The method according to claim 33 including providing the shaft with a surface hardness within about 58 to about 63 Rockwell C.

35. The method according to claim 33 wherein the alloy composition has about 0.46% carbon (C), 0.28% manganese (Mn, 0.020% phosphorous (P), 0.010% sulfur (S), 0.10% silicon (Si), 0.08% chromium (Cr), 0.02% molybdenum (Mo), 0.20% copper (Cu), and 0.025% aluminum (Al), the balance being essentially iron (Fe).

36. A driveline component comprising:

a core having a steel composition including about 0.3-0.75 wt % of carbon, about 0.15-0.40 wt % of manganese, and a balance of iron; and a case at least partially surrounding the core, the case having a non-uniform case depth extending between an outer surface of the case and the core.

37. The driveline component as recited in claim 36, wherein the core includes a core hardness of about 50 Rockwell C and the case includes a case hardness of about 58-63 Rockwell C.

38. The driveline component as recited in claim 36, wherein the case includes a carbon concentration gradient and a nitrogen concentration gradient between the outer surface and the core.

* * * * *